United States Patent [19]

Altshuler

[11] 4,051,479

[45] Sept. 27, 1977

[54] ELF VERTICAL DIPOLE ANTENNA SUSPENDED FROM AIRCRAFT

[75] Inventor: Saul Altshuler, Manhattan Beach, Calif.

[73] Assignee: TRW Inc., Redondo Beach, Calif.

[21] Appl. No.: 667,795

[22] Filed: Mar. 17, 1976

[51] Int. Cl.[2] ..... H01Q 1/28; H01Q 9/18

[52] U.S. Cl. ..... 343/703; 343/706; 343/750; 343/899

[58] Field of Search ..... 343/705, 706, 707, 708, 343/703, 750, 899

[56] References Cited

U.S. PATENT DOCUMENTS 1,296,687 3/1919 Nichols ..... 343/706

*Primary Examiner*—Eli Lieberman

*Attorney, Agent, or Firm*—Daniel T. Anderson; Edwin A. Oser; Jerry A. Dinardo

[57] ABSTRACT

A vertical dipole antenna for the ELF (extremely low frequency) range. The antenna provides a series resonant circuit consisting of an inductor and the distributed capacitance of the conductor such as a wire which may be carried by lighter-than-air craft. The lighter-than-air craft may be conductive, in which case it contributes to the capacitance or the capacitance may be solely represented by the wire. The antenna may be frequency or phase modulated. In case of frequency modulation the frequency of the generator must be changed accordingly so that the series resonant circuit remains resonant at the frequency to be radiated. The antenna can be readily moved. A plurality of antennas may be provided to form a super-radiant array.

2 Claims, 5 Drawing Figures

ELF VERTICAL DIPOLE ANTENNA SUSPENDED FROM AIRCRAFT

BACKGROUND OF THE INVENTION

This invention relates generally to antennae and particularly relates to a vertical dipole antenna suitable for the ELF range.

The ELF (extremely low frequency) range extends below 1,000 Hz to approximately 10 Hz. It has long been recognized that this frequency range is particularly suitable for long range communications and for communications with a vessel under the surface of the ocean. In this connection reference is made to a paper by John Merrill entitled "Some Early Historical Aspects of Project Sanguine" which appears in IEEE Transactions on Communications, Volume COM-22, No. 4, April 1974, pages 359–363.

Radiating at the ELF range can be used not only for communication under the ocean, but also for geophysical exploration because the radiation penetrates through a greater depth. Project Sanguine was based on a horizontal antenna of great length and suitably grounded. Similar devices have been proposed in the patent to Gutton et al., U.S. Pat. No. 3,670,247. The antenna proposed here is intended to radiate from the surface of the water.

An ELF antenna for use on the ground has been proposed in the patent to Tanner U.S. Pat. No. 3,215,937. The antenna is loaded by space capacitors and fed by a center inductor. Also, a closed configuration has been proposed. However, again the antenna is a horizontal antenna.

It can be shown that a vertical dipole is considerably more efficient and permits to radiate greater power than a horizontal antenna. One of the reasons is that a vertical or electric dipole couples more readily with the waveguide formed by the ground and the ionosphere. Thus, the improvement of a vertical over a horizontal dipole is proportional to $(\lambda/S)^2$, where $\lambda$ is the wavelength and S the size of the radiator. More specifically the power radiated by a vertical electric dipole divided by the power radiated by a magnetic dipole is $10^6(l/L)^2$. In this formula $l$ is the length of the vertical dipole antenna and L is that of the end grounded horizontal antenna. It is assumed for this calculation that the wavelength is 3,000 Km (kilometers) and the skin depth of the ground is 2 Km. Hence, by way of example, a vertical antenna 1 kilometer long will radiate as much power as a horizontal antenna having a length of 1000 Km and carrying the same current. If the horizontal antenna is not grounded, the same conclusion holds true.

Various vertical antennas have been disclosed in the prior art. Thus, reference is made to the patent to Eisenstein U.S. Pat. No. 930,746. This antenna was intended for a frequency of 30 khz which is well above the ELF range. Both a coil and a capacitor are at the top of the antenna; however, the patent does not disclose any manner of modulating such an antenna.

Another early patent to Kitsee U.S. Pat. No. 651,361 shows a balloon for carrying the high voltage coils for an antenna. The inductor is disposed near the balloon. Modulation takes place by telegraphy or the like. However, the frequency range has not been indicated.

The patent to Kline U.S. Pat. No. 3,372,395 does relate to a VLF (30 khz) antenna which is above the ELF range. The antenna is of the inductive type and consists of an inductor wound about a magnetic core to provide a large inductance. The patent to Hafner U.S. Pat. No. 3,566,317 discloses a surface wave transmission line having a winding mechanism to vary its length.

It is also proposed to utilize an airplane carrying the line in a floating structure to move the antenna through the air. The patent to Schaad et al. U.S. Pat. No. 3,660,760 discloses among other things an inductive communication system consisting of horizontal wires and a switching device for the purpose of selectively adding a conductor to the system. This in turn will vary the inductive feed pattern.

It is accordingly an object of the present invention to provide a vertical dipole antenna suitable for use in the ELF range.

Another object of the present invention is to provide such an antenna which is more efficient than a horizontal antenna whether end grounded or not and which may be frequency or phase modulated.

A further object of the present invention is to provide a vertical dipole antenna for ELF communications which may consist of a plurality of synchronized radiators thereby to increase the radiated power substantially over that of a single antenna to form a super radiant antenna.

SUMMARY OF THE INVENTION

In accordance with the present invention there is provided a vertical dipole antenna forming an electric dipole and suitable for radiating in the ELF range. The antenna comprises a generator which generate alternating electric currents in the ELF range, that is between 1,000 Hz and 10 Hz. There is further provided an inductor and an extended conductor such as a wire. A lighter-than-air craft such as a blimp or balloon carries the wire to which the inductor is secured. The inductor and the distributed capacitance of the antenna jointly form a series resonant circuit resonating at the frequency of the generator. A modulator is connected to the conductor or wire for modulating the radiation transmitted by the antenna in accordance with data to be transmitted. The modulator is connected to the conductor or wire for modulating the radiation transmitted by the antenna in accordance with data to be transmitted. The modulator may modulate either the phase or the frequency to provide phase shift keying or frequency shift keying. Finally, the conductor is properly grounded in the earth or sea.

The novel features that are considered characteristic of this invention are set forth with particularity in the appended claims. The invention itself, however, both as to its organization and method of operation, as well as additional objects and advantages thereof, will best be understood from the following description when read in connection with the accompanying drawing.

DESCRIPTION OF THE PREFERRED EMBODIMENTS

Figure 1:
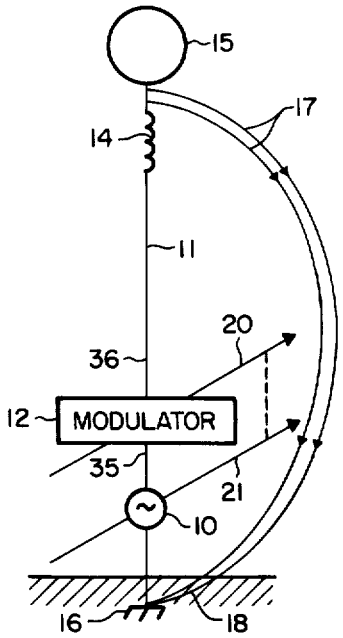
FIG. 1 is a schematic representation of a vertical dipole antenna in accordance with the present invention.

Referring now to the drawing wherein like elements are designated by the same reference numerals and particularly to FIG. 1, there is shown an antenna suitable for the ELF range.

The antenna of FIG. 1 includes a generator 10 for generating sinusoidal waves or alternating electric currents in the ELF range, that is to say between 10 and 1000 Hz.

The generator 10 is connected to an extended conductor 11 such, for example as a metallic wire. A modulator 12 is interposed between the generator 10 and an inductor 14 and connected to the wire 11. The vertical dipole antenna thus described may be of substantial length and may be carried aloft by a lighter-than-air craft 15 such, for example, as a balloon or blimp.

The inductor 14 jointly with the distributed capacitance of the antenna forms a series resonant circuit which resonates at the frequency of the wave generated by the generator 10. The distributed capacitance may be represented simply by the wire 11. Alternatively, the balloon 15 may be made electrically conductive to add to the capacitance of the antenna. The antenna is grounded as shown at 16 to provide a return path for the displacement current shown by the lines 17. The displacement current will eventually flow through the earth or ground as shown at 18 to provide a ground conduction current so that a closed loop is formed.

As shown by the arrow 20, the modulator 12 may be varied for the purpose of transmitting information. When the modulation is a frequency modulation the frequency of the generator 10 is also varied or modulated as indicated by the arrow 21. In that case, the variations of the modulator 12 and of the generator 10 takes place in unison to provide frequency shift keying in a manner to be subsequently explained.

In accordance with the present invention a plurality of radiator elements may be provided which jointly form a single antenna. For example, for a frequency of 100 Hz the wavelength is 3,000 kilometers which is about half the radius of the earth. For such a long wavelength individual radiators may be placed at random because their distance from each other is very small compared to the wavelength. Supposing N radiating elements are provided and supposing they are all radiating in phase, then the power of the resulting antenna is $N^2$ that of each individual radiator.

A plurality of radiating elements may be synchronized, for example, by a suitable radio signal from a central transmission station. Alternatively, they may be synchronized by signals transmitted from a transmitter over wires. The manner of synchronizing the radiating element is conventional and hence need not be further described here.

It should be noted, as explained before, that the lighter-than-air craft 15 need not necessarily be conductive. In that case, the necessary capacitance may be represented simply by the wire 11. This has the advantage that the balloon or blimp 15 only has to be designed to carry aloft the wire 11 and the inductor 14. It need not be dimensional to provide the required capacitance.

In any case, the needed capacitance is not too large because the power of each radiating element need not be very large. By way of example, the length of the wire 11 may be 3 kilometers and the inductance of the inductor 14 may be 125 Henry. The current may amount to 1.2 ampere and the voltage 100 kilovolts. In this case, the power radiated is 0.01 watts for each radiating element. Assuming there are 100 such radiators to form a single antenna the overall power radiated is 100 watts.

As mentioned before, the modulator 12 may serve the purpose to modulate the frequency radiated. This may, for example, be effected by the saturable reactor shown in FIG. 2. The reactor consists of a magnetic material 25 having two rectangular openings 26 and 27. A wire 28 is wound about the two legs 30 and 31 formed by the two openings 26 and 27. The windings 32 and 33 form an inductance interposed into the wire 11 between the wire portions 35 and 36, that is between the generator 10 and the inductor 14.

The magnitude of the inductance provided by the windings 32, 33 can now be varied or changed by a winding 38 interposed between the two openings 26 and 27 and which extend through the central leg 40. A voltage source such as a battery 41 is connected to the winding 38 through a variable resistor 42. By means of a switch 43, the battery 41 can be directly connected across the winding 38 to change the flux through the inductor. The switch 43 may be controlled by a data input source 44.

It will be evident that this arrangement will provide frequency shift keying by periodically changing the inductance of the antenna in accordance with the data.

In general, however, the bandwidth of any carrier depends on the Q of the transmitting antenna. The bandwidth for the present invention is extremely small, although it could be increased by adding dissipation or resistance into the inductor. A small bandwidth in turn would require that the modulation rate be very low.

Figure 2:
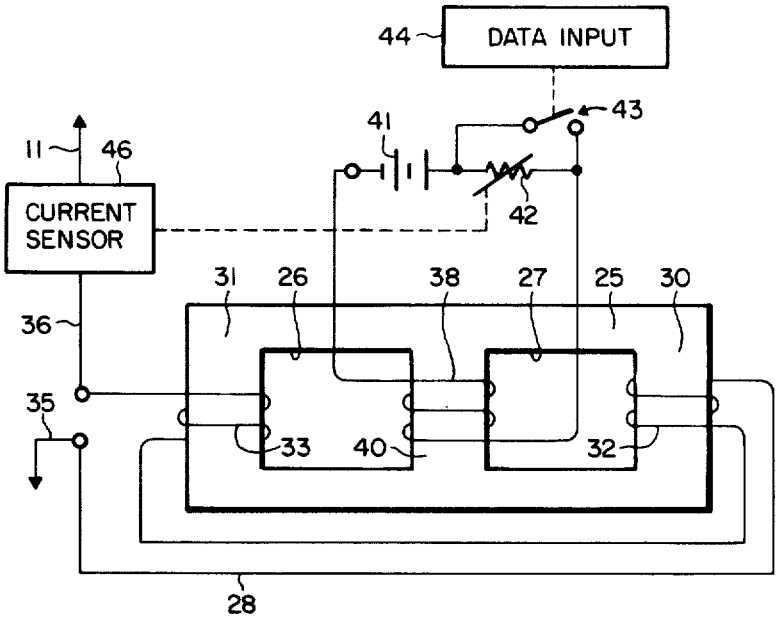
FIG. 2 is a circuit diagram of a saturable reactor, the inductance of which may be varied in accordance with some data input and including means for varying the inductance of the reactor in accordance with changes of capacitance of the antenna.

Hence in accordance with the present invention, the communication bandwidth is increased by allowing the frequency of the generator 10 to be changed in unison with the change of the inductance provided by the saturable reactor of FIG. 2. The generator 10 may consist, for example, of an oscillator and power amplifier element, the frequency of which can be rapidly changed say from $f_0$ to $f_1$. Solid state amplifiers with appropriate electronically controllable frequency are known in the art. It is possible to distinguish a difference of 3 Hz by a conventional receiver. The bit rate $1/T$ obtainable is determined by the following formula:

$$f_0 - f_1 \geqq 1/T \qquad (1)$$

Hence, $T$ is the duration of each pulse. If $f_0 - f_1$ is 3 Hz, the bit rate is about 3 bits per second.

It is also feasible with the arrangement of FIG. 2 to compensate for variations of the capacitance. This may be effected by a current sensor 46 interposed between the conductor portion 36 and the wire 11. This will sense variations of the current flowing in the wire 11 due to variations of the capacitance. This in turn can be compensated by variations of the resistor 42 connected in series with battery 41 and winding 38 to compensate for the changes of the capacitance. By way of example, the resistor 42 may consist of a transistor biased to form a variable resistor controlled by the sensor 46.

Figure 3:
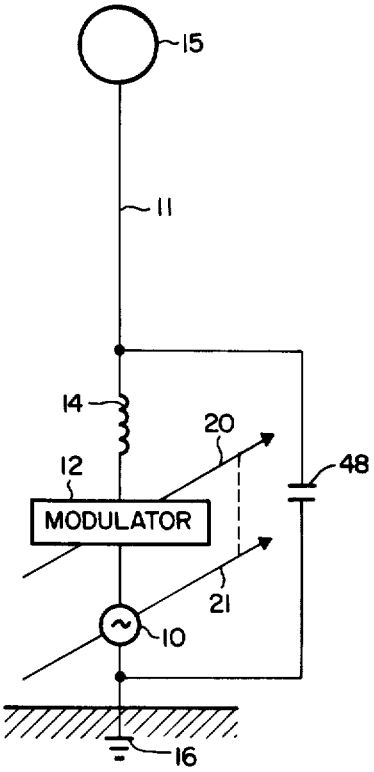
FIG. 3 is a schematic representation of a vertical dipole antenna in accordance with the present invention having an inductor disposed close to the ground.

In FIG. 1 the inductor 14 has been shown adjacent to the balloon or blimp 15. This has the advantage that the voltage drop between the radiating wire and ground is small thus preventing corona discharge. However, as illustrated in FIG. 3, it is also feasible to dispose the inductor 14 near the ground and adjacent by the modulator 12. This has the advantage that the weight of the inductor need not be close to the balloon 15.

Also shown in FIG. 3 is a capacitor 48 connected in parallel to the inductor 14 and having its other terminal connected to ground 16. This capacitor is optional, but it serves the purpose to add capacity to the antenna. With a larger combined capacitance the inductance at the same resonant frequency can be made lower. Hence for some applications it may be desirable to select the inductance of inductor 14 to be a smaller value and to add a capacitor 48 substantially in parallel with inductor 14 to provide the same resonant frequency.

Figure 4:
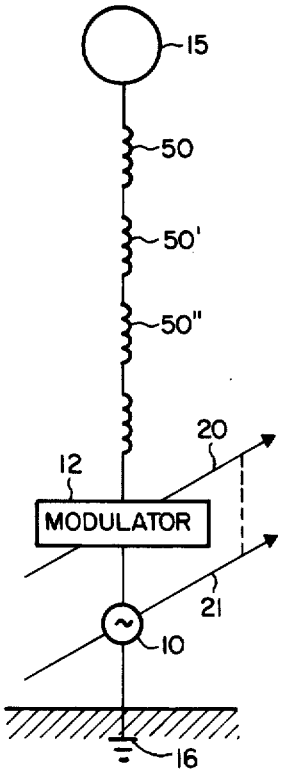
FIG. 4 is a schematic representation of an antenna embodying the present invention and having a plurality of separate elements representing the inductor for minimizing the voltage drop across each element.

In case the voltage drop across the inductor 14 is large, it may be desired to provide a plurality of individual inductor elements such as 50, 51" etc. as shown in FIG. 4. Otherwise, the antennas of FIGS. 3 and 4 are identical to that of FIG. 1.

As indicated before, it is also feasible to provide phase modulations of the antenna. This will provide a phase shift keying system and such a modulator has been illustrated in FIG. 5. Here the generator 10 has its two terminals connected to a double-pole, double-throw switch 52. The switch arm 53 is connectable either to the wire 11 or to a conductor 54 which in in turn is grounded. The same is true of the switch arm 55. The two switch arms are controlled by a switch control 56 which may, for example, be a relay controlled in turn by the data input.

It will now be evident that the phase of the wave generated by the generator 10 can be reversed or changed by simply moving the switch arms 53, 55 from the position shown in FIG. 2 to the other position where the two switch arms extend downwardly.

Figure 5:
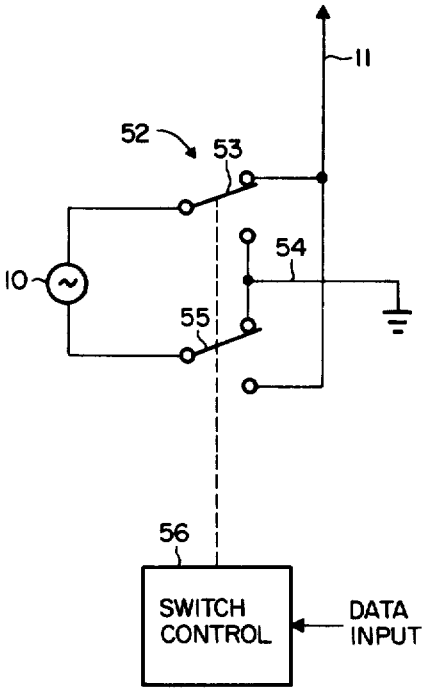
FIG. 5 is a circuit diagram of a switch controlled by data input for reversing at will the phase of the currents flowing in the antenna.

It will be realized that the phase shift keying described in connection with FIG. 5 does not require a variation or change of the frequency of the generator 10. Hence for the phase shift keying the arrow 21 may be omitted which indicate changes of the phase. Otherwise, the phase shift keying operates in the same way as does the frequency shift keying previously described. It should be noted that the vertical dipole antenna of the present invention is relatively light weight and can be readily moved from one place to another for ease of communications. For example, the entire antenna may be bolted down, the wire rolled up and the balloon 15 deflated until the antenna is needed again. As stated before, a plurality of radiating elements jointly forming should be inserted antenna may be used. In view of the very long wavelengths the individual radiating elements may be placed at will over an extended area on land or sea.

There has thus been disclosed a vertical dipole antenna or an electric dipole for ELF communication. Such an electric dipole has a substantially greater efficiency than that of a horizontal or magnetic dipole. By providing a plurality of radiating elements, a relatively large power can be generated without the need of providing a large inductance or a large voltage for each radiating element. The antenna may be readily modulated by either phase or frequency shift keying. In spite of the fact that the carrier has extremely low frequency bandwidth it is possible to provide frequency shift keying by shifting the frequency of the radiator while simultaneously changing the inductance of the system so that the antenna remains resonant with the instantaneous frequency generated.

What is claimed is:

1. A vertical dipole antenna suitable for radiating information in the ELF range, said antenna comprising:
   a. a generator for generating alternating electric currents in the ELF range;
   b. an inductor;
   c. a lighter-than-air craft;
   d. an extended conductor connecting said generator and said inductor and connected to said lighter-than-air craft for carrying said conductor, said inductor and the distributed capacitance of said antenna forming a series resonant circuit;
   e. means for grounding said conductor;
   f. a modulator connected to said conductor and consisting of a saturable reactor;
   g. means controlled by the information for changing at will the inductance of said reactor; and
   h. means for changing the frequency of said generator in unison with the change of inductance provided by said saturable reactor, so that the series resonant circuit of said antenna including the inductance of said reactor will resonate at the instantaneous frequency of said generator, thereby to increase the communication bandwidth of the antenna.

2. The antenna defined in claim 1 wherein means is provided including a current sensor for varying the inductance of said saturable reactor in accordance with changes of the capacitance represented by said conductor and said lighter-than-air craft.

* * * * *